US005310022A

United States Patent [19]

Sheridan et al.

[11] Patent Number: 5,310,022

[45] Date of Patent: May 10, 1994

[54] MECHANICAL OVERSPEED SAFETY DEVICE

[75] Inventors: William Sheridan, Southington; Anthony Cooney, Farmington, both of Conn.

[73] Assignee: Otis Elevator Company, Farmington, Conn.

[21] Appl. No.: 854,528

[22] Filed: Mar. 20, 1992

[51] Int. Cl.[5] ..... D66B 5/16

[52] U.S. Cl. ..... 187/89; 188/189

[58] Field of Search ..... 187/88, 89, 90, 73, 187/74; 188/188, 189, 180

[56] References Cited

U.S. PATENT DOCUMENTS

| | | | |
|---|---|---|---|
| 1,959,528 | 5/1934 | Federici | 187/89 |
| 3,327,811 | 6/1967 | Mastroberte | 187/89 |
| 4,029,177 | 6/1977 | Fiss | 187/89 |
| 4,977,982 | 12/1990 | Bialy et al. | 187/89 |

OTHER PUBLICATIONS

Sheridan et al., U.S. Ser. No. 679,873, Apr. 3, 1991.

*Primary Examiner*—Robert P. Olszewski
*Assistant Examiner*—Kenneth Noland
*Attorney, Agent, or Firm*—Richard D. Getz

[57] ABSTRACT

An overspeed governor comprises a pair of wedge brakes for selectively acting against a brake surface attached to the rotational shaft of an elevator drive. A maintaining apparatus is provided to maintain the wedge brakes in a normal position, out of engagement with the brake surface. A centrifugal actuating apparatus is also provided, attached to the rotational shaft of the elevator drive. If the rotational velocity of the elevator drive exceeds a predetermined limit, the centrifugal actuating apparatus displaces the maintaining apparatus, thereby allowing one of the wedge brakes to engage the brake surface.

13 Claims, 3 Drawing Sheets

MECHANICAL OVERSPEED SAFETY DEVICE

TECHNICAL FIELD

This invention relates to rope supported elevators and more specifically to overspeed governors therefore.

BACKGROUND ART

An elevator comprises an elevator car and a counterweight attached to each other by a series of ropes. The ropes extend up the hoistway from the elevator car to the machine room of the elevator. In the machine room, the ropes wrap around a sheave attached to an elevator drive and return down the hoistway attaching to the counterweight. In an elevator with a geared elevator drive, a drive motor drives the sheave through a intermediary gear arrangement. In an elevator with a gearless drive, conversely, the sheave is fixed to the rotational axis of the drive motor. Consequently, the drive motor directly drives the sheave, hence the "gearless" drive.

For safety reasons, elevators are generally required to have an overspeed governor and safeties. Early governor embodiments included a governor rope extending the length of the hoistway, attached to a governor sheave and tensioner. If the downward velocity of the elevator exceeded a predetermined limit, an overspeed condition, a centrifugal flyweight assembly driven by the governor sheave would swing outwardly, tripping a switch thereby removing power to the elevator drive and brake. If the downward elevator speed continued to increase, the flyweight assembly would swing outwardly still further and operate a governor brake. The governor brake would apply a frictional drag force to the governor rope, thereby actuating a pair of coordinated safeties in communication with the rope. The safeties, attached to the elevator car, acted on a pair of rails guiding the elevator. This entirely mechanical system, while effective, presented a number of problems.

First, the governor assembly and safeties protected against overspeed conditions only when the elevator car was descending. In the event of a brake failure or a drive gear failure in a geared machine, for example, a heavier counterweight will cause a lighter elevator car to accelerate upwardly. The unidirectional limitation of the aforementioned governor and safeties renders them powerless to stop an upwardly accelerating car.

Second, the centrifugal nature of the governor makes the governor inoperable at low elevator speeds. If an elevator leaves a landing with an open door because of a faulty brake, for example, a centrifugally operated governor will not stop the elevator car until it has reached an overspeed condition.

Third, the complete governor assembly was costly and burdensome to maintain due in part to the high-wear nature of some of the assembly's elements. For example, the governor brake typically comprised a swinging jaw mechanism that pinched the governor rope. As a result, the governor rope was subject to undesirable wear. In addition, the safeties actuated by the governor rope stopped the car by scoring the rail.

U.S. Pat. No. 4,977,982 discloses an "Elevator Sheave Brake Safety" comprising an electromechanically actuated overspeed governor for use with either geared or gearless drive elevators. Unlike the aforementioned early embodiments, this patent employs a pair of wedge brakes operating against a brake surface attached to the drive. The wedges are maintained in the "off" mode by an energized solenoid which receives its power based on a signal from a peripherally mounted speed detecting means. In the event of an overspeed condition, the solenoid is de-energized and the wedges are biased against the brake surface. Depending on the rotational direction of the brake surface, one of the brake wedges is drawn into engagement with the brake surface, thereby stopping the drive. The other wedge is maintained out of engagement with the brake surface. Rotation of the brake surface in the opposite direction results in the engaging wedge brake and the non-engaging wedge brake trading places.

Hence, one of the advantages of U.S. Pat. No. 4,977,982 is its capability to control overspeed conditions in either direction. Another advantage of U.S. Pat. No. 4,977,982 is that it eliminates the need for almost all of the governor hardware including the governor sheave, rope and tensioner. The elimination of these conventional devices saves money on both the initial installation and continued maintenance of the elevator. Moreover, it also saves a considerable amount of room in the always congested hoistway.

Changing code requirements and preferences, however, may favor a mechanically operated governor with the aforesaid advantages, rather than the above described brake which utilizes electrical solenoids and speed detecting means.

DISCLOSURE OF THE INVENTION

It is therefore an object of the present invention to provide a cheaper, more efficient mechanically actuated overspeed device.

According to the present invention, an overspeed governor is provided comprising a pair of wedge brakes for selectively acting against a brake surface attached to a rotational shaft of an elevator drive means. A maintaining means is provided to maintain the wedge brakes in a normal position, out of engagement with the brake surface. A centrifugal actuating means is attached to the rotational shaft of the elevator drive. If the rotational velocity of the elevator drive exceeds a predetermined limit, the centrifugal actuating means displaces the maintaining means, thereby allowing one of the wedge brakes to engage the brake surface.

An advantage of the present invention is that it provides overspeed protection in either direction of elevator car travel. A further advantage of the present invention is that it eliminates the need for almost all of the conventional governor hardware including the governor sheave, rope and tensioner. The elimination of these devices saves money on both the initial installation and continued maintenance of the elevator. Moreover, it also saves a considerable amount of room in the hoistway.

A still further advantage of the present invention is that it limits the operation of the safeties solely to those instances in which a support rope breaks or during maintenance. Guide rails represent a considerable amount of an elevators cost and it is therefore a significant advantage to minimize guide rail wear.

A still further advantage of the present invention is that it is entirely a mechanical device. The present invention will, therefore, conform to safety codes requiring mechanical overspeed devices.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
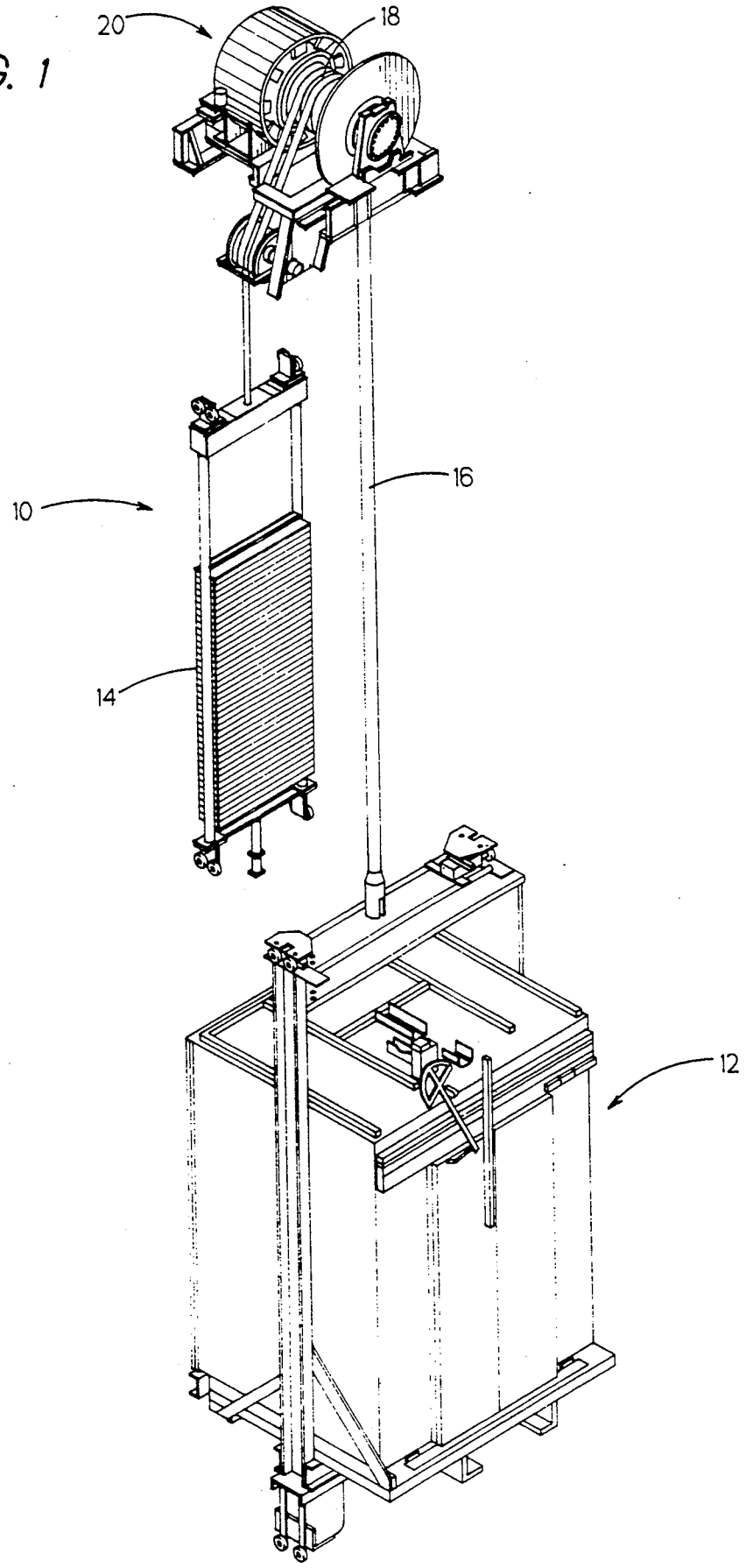
FIG. 1 is a diagrammatic view of an elevator comprising an elevator car, a counterweight, and a gearless elevator drive.

Referring to FIG. 1, an elevator 10 comprises an elevator car 12 and a counterweight 14 attached to each other by a series of ropes 16. The ropes extend up the hoistway (not shown) from the elevator car 12 to the machine room of the elevator 10. In the machine room, the ropes 16 wrap around a sheave 18 attached to an elevator drive 20 and return down the hoistway attaching to the counterweight 14.

Figure 2:
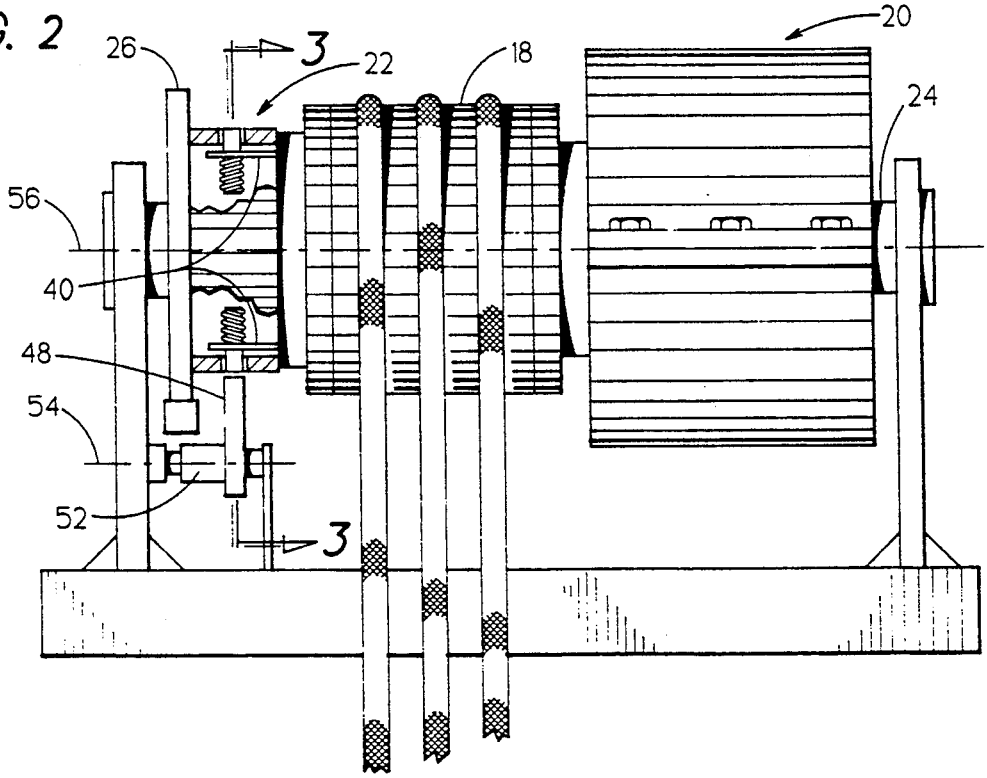
FIG. 2 is a diagrammatic view of a gearless elevator drive comprising a drive motor, a sheave, a brake rotor and the present invention.
Figure 3:
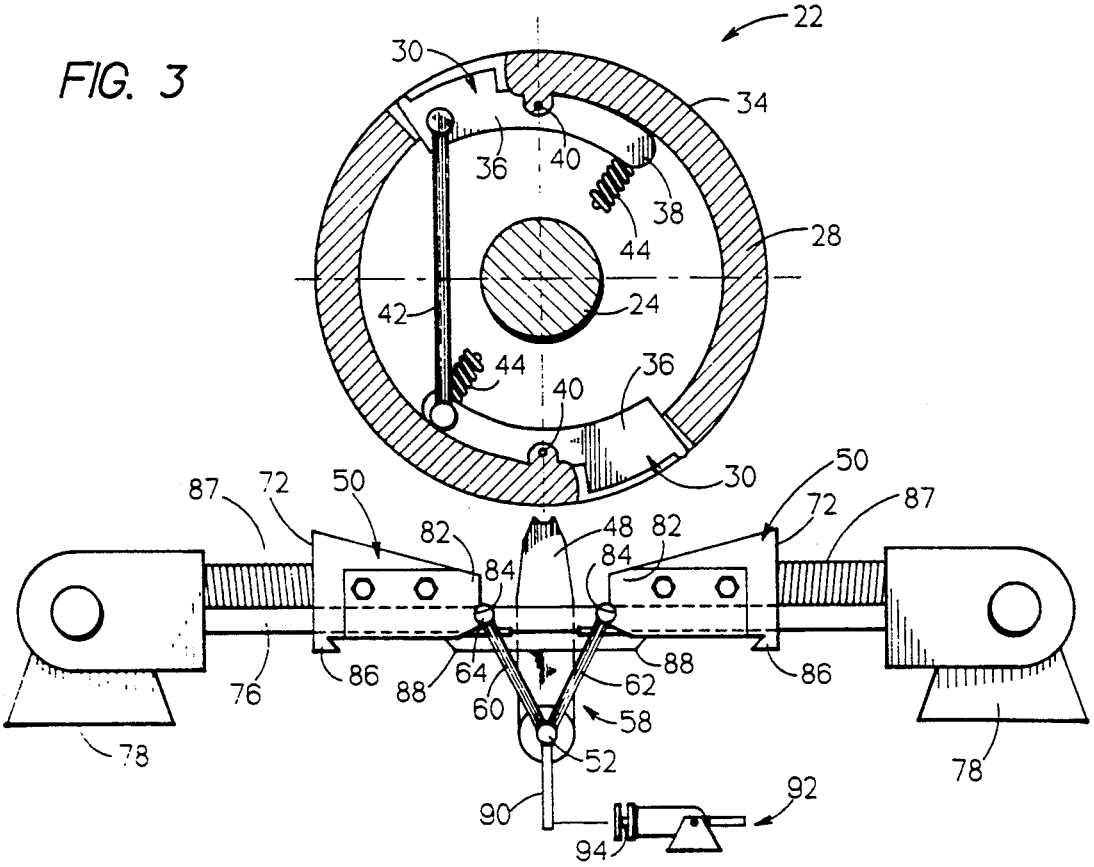
FIG. 3 is a cross-sectional view of the centrifugal actuating means, linkage and wedge brake arrangement shown in FIG. 2, in the normal position.

Now referring to FIGS. 2 and 3, a centrifugal actuator 22 is fixed to a rotational shaft 24 of the elevator drive 20, between the sheave 18 and a brake rotor 26. A person of skill in the art will recognize that the centrifugal actuator 22 may be positioned in a number of different positions relative to the elevator drive 20 depending on whether the drive 20 is geared or gearless. The centrifugal actuator 22 comprises a housing 28 and a pair of pivotally mounted centrifugal masses 30. (See FIG. 3) The housing 28 is a cylindrical body having an inner 32 and outer surface 34. The centrifugal masses 30 have a body 36 and a shank 38 extending out from the body 36. Each mass 30 is pivotally attached to the inner surface 32 of the housing 28. A pivot lug 40, fixed to the housing 28, extends through each mass 30 at a position offset from the body 36 of the mass 30, thereby enabling the body 30 to pivot about the lug 40. An adjusting spring 44 biases the shank 38 of each mass 30 against the inner surface 32 of the housing 28. The masses 30 are attached to one another by a connecting rod 42. The rod 42 acts as a failsafe in the event one of the adjusting springs 44 fails. The rod 42 also averages the centrifugal timing of the masses 30 by making them act in concert.

Figure 4:
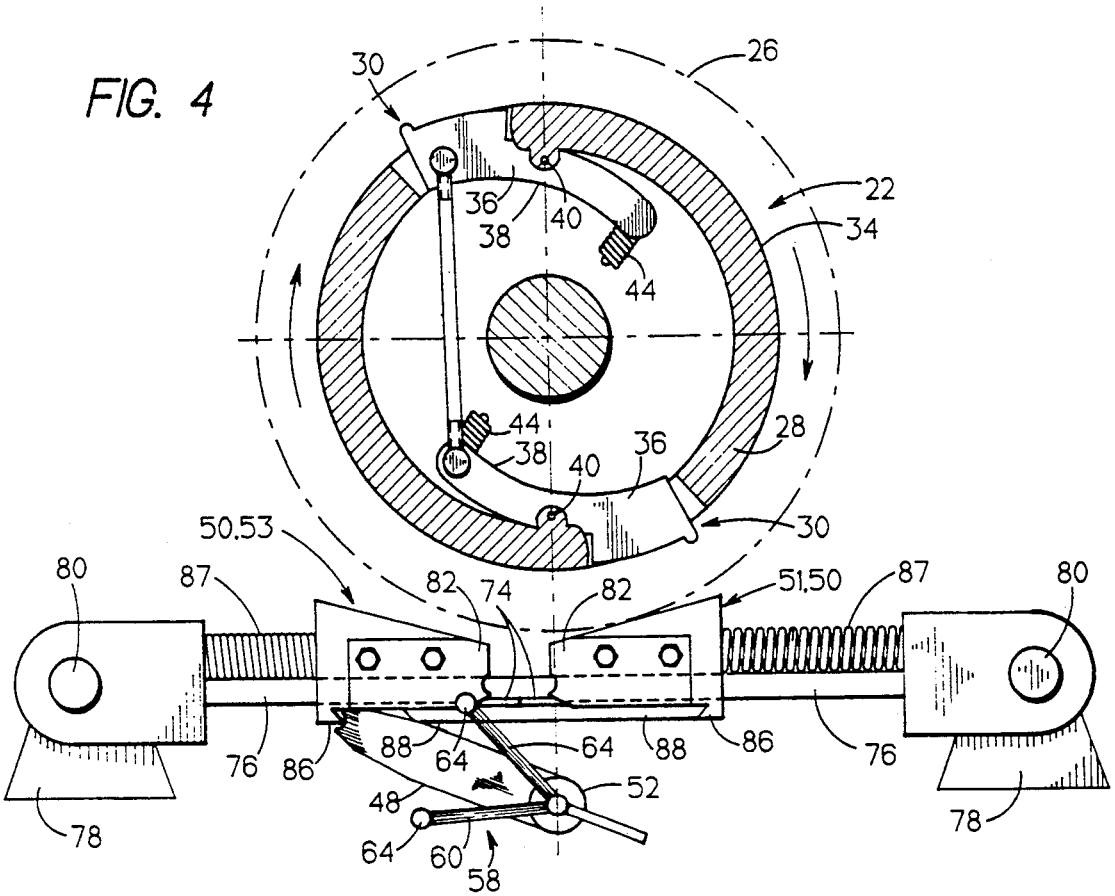
FIG. 4 is a cross-sectional view of the centrifugal actuating means, linkage and wedge brake arrangement shown in FIG. 3, displaced from the normal position by the centrifugal actuating means.

Now referring to FIGS. 3 and 4, a lever 48 comprises part of an assembly that maintains a pair of wedge brakes 50 in a normal position, out of engagement with the brake rotor 26. The lever 48 is attached to a pivotally mounted yoke 52 which pivots about an axis 54 parallel to the rotational axis 56 of the drive 20. (See FIG. 2) The assembly further comprises a retainer 58, also fixed to the yoke 52. The retainer 58 includes a first arm 60 and a second arm 62 extending outwardly from the yoke 52. A bearing surface, for example a roller 64, is attached to the outer end of each arm 60,62. The lever 48 and the retainer 58 maintain a fixed relationship between one another. The assembly still further comprises a tang 90 extending out from the yoke 52, in a fixed relationship with the retainer 58.

Figure 5:
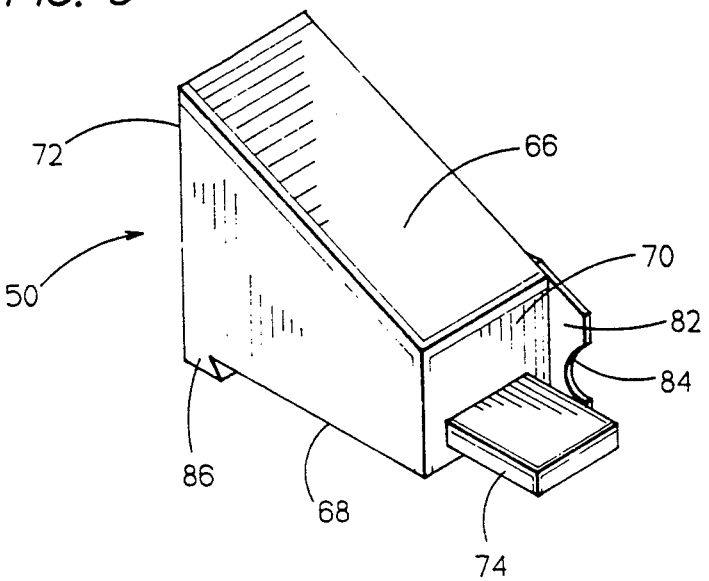
FIG. 5 is a diagrammatic view of a wedge brake.

Referring to FIGS. 4 & 5, the wedge brakes 50 comprise a wedge-like geometry having a brake surface 66 and a bottom surface 68 opposite one another and a front 70 and rear surface 72 also opposite one another. An extension 74 projects out from the front surface 70 of each wedge brake 50. The bottom surface 68 of the wedge brakes 50 slidably contacts and is constrained to motion along a flat leaf spring 76 positioned adjacent the centrifugal actuator 22. Alternatively, bearings (not shown) may be implemented between the wedge brakes 50 and the leaf spring 76 to facilitate movement therebetween. Each wedge brake 50 further includes an angularly disposed catch 86 that communicates with a mating angular surface 88 disposed in the leaf spring 76, as will be discussed infra. A clevis mount 78, attached to each end of the leaf spring 76, mounts the leaf spring 76 to the elevator drive frame (not shown). The pivot 80 of at least one of the clevis mounts 78 contains enough clearance to prevent the leaf spring 76 from binding should the leaf spring 76 deflect. A retainer plate 82 having a contoured surface 84 (See FIG. 5) is attached to each wedge 50. A person skilled in the art will recognize that the brake surface 66 of the brake wedge 50 may comprise a number of different geometries (not shown) depending on the geometry of the brake rotor 26.

Referring to FIG.3, in the normal position, a coiled spring 87 acting between the clevis mount 78 and the back surface 72 of a wedge brake 50 biases each wedge brake 50 against the retainer 58. Specifically, the contoured surface 84 comprised within each retainer plate 82 accepts the roller 64 attached to the end of each retainer arm 60,62. The contoured surface 84 and roller 64 combination creates a detente for the retainer 58 in the normal position.

Referring to FIGS. 4 & 5, in the event of an overspeed condition, the centrifugal forces acting on the masses 30 of the revolving centrifugal actuator 22 overcome the spring 44 biases on the shanks 38. As a result, the body 36 of each mass 30 pivots about the pivot lug 40 until the body 36 extends outside of the outer surface 34 of the housing 28. When the centrifugal mass bodies 36 have extended outside the housing 28 far enough, they will strike the lever 48 part of the assembly maintaining the wedges 50 out of engagement. The lever 48, and therefore the yoke 52 and the retainer 58, will rotate about an axis 54 parallel to the rotational axis 56 of the drive 20. (See FIG. 2) Rotating the retainer 58 out of the normal position causes the rollers 64 attached to the arms 60,62 to dislocate from the contoured surfaces 84 (See FIG. 5) of the retainer plates 82. As a result, the retainer 58 swings free, out of engagement with the wedge brakes 50.

Once the retainer 58 rotates, the coiled springs 87 bias the wedges 50 tangentially toward the brake rotor 26, slidably following the leaf spring. Depending on the rotational direction of the drive 20, one of the wedge brakes 51 (See FIG. 4) will be drawn into engagement with the brake rotor 26. The extension 74 projecting out from the front 70 of the engaging brake wedge 51 will contact the extension 74 of the non-engaging brake wedge 53, thereby maintaining the latter brake wedge 53 out of engagement. Rotation in the opposite direction will result in the engaging 51 and non-engaging brake wedges 53 trading places, thus the wedge brakes 51 will engage in either rotational direction.

The engaging wedge brake 51 is radially biased against the brake rotor 26 by the leaf spring 76. The resilient leaf spring 76 provides a percentage of the braking force and prevents the wedge 51 from binding up between the spring 76 and the rotor 26. In addition, when the engaging wedge brake 51 moves into position, the angularly disposed catch 86 attached to the wedge 51 registers with the mating angular surface 88 disposed in the leaf spring 76. Consequently, the angular catch 86 prevents the back surface 72 of the wedge 51 from pivoting away from the spring 76.

Referring to FIGS. 3 and 4, in the event the elevator car 12 leaves a landing (not shown) with a door open, a signal indicating such may be sent to a solenoid 92 positioned adjacent the tang 90 attached to the pivotally mounted yoke 52. Upon receiving the signal, the core section 94 of the solenoid 92 extends outward contacting the tang 90. As a result, the retainer 58 is rotated out of engagement with the wedge brakes 50. One of the wedge brakes 50, the engaging wedge brake 51, is consequently drawn into contact with the brake rotor 26, thereby stopping the elevator car 12.

Although this invention has been shown and described with respect to the detailed embodiments thereof, it will be understood by those skilled in the art that various changes in form and detail thereof may be made without departing from the spirit and scope of the claimed invention.

We claim:

1. A bidirectional overspeed governor for an elevator having a rope supported elevator car in a hoistway and a drive means having a rotational shaft and a brake surface fixed to said shaft, for driving said elevator car within said hoistway, said governor comprising:

a pair of wedge brakes, for selectively acting against the brake surface in either direction of rotation;

mechanical maintaining means for maintaining said wedge brakes in a normal position, out of engagement with the brake surface; and centrifugal actuating means for displacing said maintaining means from said normal position if the rotational velocity of the drive means exceeds a predetermined limit in either direction of rotation, thereby allowing one of said wedge brakes to engage the brake surface.

2. An overspeed governor for an elevator according to claim 1, wherein said maintaining means comprises:

a retainer, pivotally mounted along an axis parallel to the rotational shaft of the drive means, wherein said wedge brakes are biased against said retainer in said normal position by a tangential biasing means; and a lever, fixed to said retainer, said centrifugal operating means being operable to rotatably displace said lever, thereby allowing one of said wedges to engage the brake surface.

3. An overspeed governor for an elevator according to claim 2, wherein said maintaining means further comprises tripping means for tripping said retainer in the event said elevator car moves in an open door condition.

4. An overspeed governor for an elevator according to claim 2, wherein said retainer further comprises: a first arm, said tangential biasing means biasing one of said wedge brakes against said first arm in said normal position; and a second arm, said tangential biasing means biasing the other of said wedge brakes against said second arm in said normal position.

5. An overspeed governor for an elevator according to claim 4, wherein said tangential biasing means comprises:

a coil spring, acting on one of said wedge brakes.

6. An overspeed governor for an elevator according to claim 2, further comprising:

radial biasing means for biasing said wedge brakes toward the brake surface, said wedge brakes slidably contacting said radial biasing means in a direction tangential to said brake surface.

7. An overspeed governor for an elevator according to claim 6, wherein said radial biasing means comprises a flat leaf spring.

8. An overspeed governor for an elevator according to claim 6, wherein said tangential biasing means comprises:

a coil spring, acting on one of said wedge brakes and a bracket, along said radial biasing means.

9. An overspeed governor for an elevator according to claim 6, wherein said wedge brakes further comprise: disengaging means, operable to maintain one of said wedge brakes out of engagement with the brake surface.

10. An overspeed governor for an elevator according to claim 9, wherein said disengaging means comprises: an extension attached to each of said wedge brakes.

11. An overspeed governor for an elevator according to claim 9, wherein said centrifugal actuating means comprises:

a cylindrical housing, fixed to the rotational shaft of the elevator drive, having an inner and an outer surface;

a centrifugal mass, pivotally attached to said housing, having a body and a shank extending out from said body; and spring means, operable to bias said shank of said centrifugal mass against said inner surface of said housing, wherein if the rotational velocity of said drive means exceeds a predetermined limit, said body of said centrifugal mass will overcome said bias and pivot, and extend outside of said outer surface of said housing, and displace said lever from said normal position, thereby allowing one of said wedges to engage the brake surface.

12. A method for stopping an ascending or descending elevator, having a drive means with a rotational shaft and a brake surface attached to said shaft, in an overspeed condition comprising the steps of:

providing a pair of wedge brakes for selectively acting against the brake surface as the elevator ascends or descends;

providing mechanical maintaining means for maintaining said wedge brakes in a normal position, out of engagement with the brake surface; and providing centrifugal actuating means for displacing said maintaining means from said normal position if the rotational velocity of the drive means exceeds a predetermined limit as the elevator ascends or descends, thereby allowing one of said wedge brakes to engage the brake surface.

13. A method of stopping an elevator in an overspeed condition according to claim 12, further comprising the steps of:

biasing said wedge brakes against said maintaining means in the normal position;

displacing said maintaining means from said normal position with said centrifugal actuating means if the rotational velocity of the drive means exceeds a predetermined limit;

tangentially biasing one of said wedge brakes into tangential engagement with said brake surface; maintaining the other of said wedge brakes out of engagement with said wedge brake;

radially biasing said wedge brake engaged with the brake surface radially toward the brake surface.

* * * * *